US009428299B2

(12) United States Patent
Mengistu et al.

(10) Patent No.: US 9,428,299 B2
(45) **Date of Patent: *Aug. 30, 2016**

(54) COLLAPSIBLE BULK BIN AND METHODS FOR CONSTRUCTING THE SAME

(71) Applicant: WestRock Shared Services, LLC, Norcross, GA (US)

(72) Inventors: Tesfahun Y. Mengistu, Sioux City, IA (US); Thomas D. Graham, Winter Garden, FL (US); John Thomas Yoder, IV, Wildwood, MO (US)

( * ) Notice: Subject to any disclaimer, the term of this patent is extended or adjusted under 35 U.S.C. 154(b) by 57 days.

This patent is subject to a terminal disclaimer.

(21) Appl. No.: 14/675,038

(22) Filed: Mar. 31, 2015

(65) Prior Publication Data

US 2015/0203240 A1 Jul. 23, 2015

Related U.S. Application Data

(63) Continuation of application No. 11/533,233, filed on Sep. 19, 2006, now Pat. No. 8,991,684.

(51) Int. Cl.
*B65D 5/36* (2006.01)
*B65D 5/32* (2006.01)
(Continued)

(52) U.S. Cl.
CPC ..... *B65D 5/326* (2013.01); *B31B 11/00* (2013.01); *B31B 17/60* (2013.01); *B65D 88/522* (2013.01); *B65D 90/02* (2013.01)

(58) Field of Classification Search
CPC ..... B65D 5/12; B65D 5/14; B65D 5/36; B65D 5/06; B65D 5/4283; B65D 5/02; B65D 5/10; B31B 2217/0007
USPC ..... 229/117.01, 110, 199, 122.27, 108.1, 229/122.28, 122.29, 117.06, 117.02
See application file for complete search history.

(56) References Cited

U.S. PATENT DOCUMENTS 917,384 A 4/1909 Walker
925,935 A 6/1909 Miner
(Continued)

FOREIGN PATENT DOCUMENTS

GB 2096971 A 10/1982

OTHER PUBLICATIONS

A Canadian Office Action, dated Aug. 1, 2014, for co-pending CA patent application No. 2,602,987 (3 pgs).
(Continued)

*Primary Examiner* — Christopher Demeree
(74) *Attorney, Agent, or Firm* — Westrock IP Legal

(57) ABSTRACT

A container configured to be selectively moved between a substantially flat position and a deployed position is provided. The container includes a first blank of sheet material for forming side walls of the container, and a second blank of sheet material for forming a bottom wall of the container. The first blank having an interior surface and an opposing exterior surface, a top edge and a bottom edge. The first blank includes a first side panel, a second side panel, a third side panel, a fourth side panel, a fifth side panel, and a sixth side panel wherein each of the side panels are coupled across a fold line. The first blank also includes end flaps extending from the bottom edge of each of the side panels wherein at least two of the end flaps includes a tab joint. The second blank having a plurality of side edges equal to a number of side panels of the first blank, each side edge having a width substantially equal to a width of the side panels of the first blank. The second blank is foldable and is coupled to at least one end flap of the first blank for forming a bottom wall of the container.

20 Claims, 6 Drawing Sheets

(51) Int. Cl.

| | |
|---|---|
| ***B65D 5/42*** | (2006.01) |
| ***B31B 11/00*** | (2006.01) |
| ***B31B 17/60*** | (2006.01) |
| ***B65D 88/52*** | (2006.01) |
| ***B65D 90/02*** | (2006.01) |

(56) References Cited

U.S. PATENT DOCUMENTS

| | | | |
|---|---|---|---|
| 1,168,565 | A | 1/1916 | Rosenwald |
| 1,555,054 | A | 9/1925 | Berkowitz |
| 2,054,473 | A | 9/1936 | Towell |
| 2,085,238 | A | 6/1937 | Towell |
| 2,165,906 | A | 7/1939 | Reich |
| 2,733,852 | A | 2/1956 | Williamson |
| 2,741,416 | A | 4/1956 | Hileman |
| 3,000,496 | A | 9/1961 | Larson |
| 3,014,637 | A | 12/1961 | Wilson |
| 3,115,292 | A | 12/1963 | Repking |
| 3,251,533 | A | 5/1966 | Cohen |
| 3,531,043 | A | 9/1970 | Carlsson et al. |
| 4,341,337 | A | 7/1982 | Beach, Jr. et al. |
| 4,392,606 | A | 7/1983 | Fremion |
| 4,418,861 | A | 12/1983 | McFarland et al. |
| 4,736,885 | A | 4/1988 | Negus, Sr. |
| 5,108,028 | A | 4/1992 | Schillaci |
| 5,351,849 | A | 10/1994 | Jagenburg et al. |
| 5,715,991 | A | 2/1998 | Gasper |
| 5,772,108 | A | 6/1998 | Ruggiere, Sr. et al. |
| 5,915,617 | A | 6/1999 | Gasper |
| 6,074,331 | A | 6/2000 | Ruggiere, Sr. et al. |
| 6,386,437 | B1 | 5/2002 | Larson, Jr. |
| 6,688,084 | B2 | 2/2004 | Yarbrough |
| RE38,631 | E | 10/2004 | Ruggiere, Sr. et al. |
| 6,918,228 | B2 | 7/2005 | Yarbrough |
| 7,381,176 | B2 | 6/2008 | Graham et al. |
| 7,434,721 | B2 | 10/2008 | Feltz |
| 2008/0188364 | A1 | 8/2008 | Graham et al. |

OTHER PUBLICATIONS

Canadian Office Action, dated Apr. 16, 2015, for co-pending Canadian patent application No. 2,602,987 (3 pgs.).

COLLAPSIBLE BULK BIN AND METHODS FOR CONSTRUCTING THE SAME

CROSS REFERENCE TO RELATED APPLICATIONS

This application is a continuation application of U.S. patent application Ser. No. 11/533,233, filed Sep. 19, 2006, entitled "COLLAPSIBLE BULK BIN AND METHODS FOR CONSTRUCTING THE SAME," the disclosure of which is hereby incorporated herein by reference in its entirety.

BACKGROUND OF THE INVENTION

This invention relates generally to packaging and, more particularly, to a collapsible bulk bin and methods for forming a collapsible bulk bin that includes a self-erecting bottom wall.

Containers are frequently utilized to store and aid in transporting products. These containers can be square, hexagonal, or octagonal. At least some known bulk containers used to transport products are designed to fit a standard sized pallet. The shape of the container can provide additional strength to the container. For example, a hexagonal-shaped bulk container provides greater resistance to bulge over conventional rectangular or square containers. An empty bulk bin can be shipped in a knocked-down flat state and opened to form an assembled bulk bin that is ready for use. Shipping and storing bulk bins in a knocked-down flat state saves money and space, however, the size and configuration of bulk bins can make the setup of the bin difficult for an individual to complete and often requires more than one person for assembly. A bulk bin that requires more than one person to complete assembly can cause unwanted expenses and wasted time for a user of the bulk bin.

BRIEF DESCRIPTION OF THE INVENTION

In one aspect, a container configured to be selectively moved between a substantially flat position and a deployed position is provided. The container includes a first blank of sheet material for forming side walls of the container, and a second blank of sheet material for forming a bottom wall of the container. The first blank having an interior surface and an opposing exterior surface, a top edge and a bottom edge. The first blank includes a first side panel, a second side panel, a third side panel, a fourth side panel, a fifth side panel, and a sixth side panel wherein each of the side panels are coupled across a fold line. The first blank also includes end flaps extending from the bottom edge of each of the side panels wherein at least two of the end flaps includes a tab joint. The second blank having a plurality of side edges equal to a number of side panels of the first blank, each side edge having a width substantially equal to a width of the side panels of the first blank. The second blank is foldable and is coupled to at least one end flap of the first blank for forming a bottom wall of the container.

In another aspect, a container configured to be selectively moved between a substantially flat position and a deployed position is provided. The container including a first blank of sheet material for forming side walls of the container, and a second blank of sheet material for forming a bottom wall of the container. The first blank having an interior surface and an exterior surface, a top edge and a bottom edge. The first blank is foldable along a plurality of fold lines to form a plurality of side walls of the container, wherein the side walls each have an end flap extending from the bottom edge and at least two of the end flaps having a tab joint extending across a fold line. Each tab joint is coupled to an adjacent end flap. The second blank of sheet material having an interior surface and an exterior surface. The second blank is foldable along a fold line and is coupled to at least one end flap of the first blank, wherein the end flaps and the tab joints of the first blank support the second blank when in the deployed position to form a bottom wall of the container.

In another aspect, a method for constructing a container is provided. The method includes providing a first blank of sheet material having an interior surface and an opposing exterior surface, a top edge and a bottom edge. The first blank includes a first side panel, a second side panel, a third side panel, a fourth side panel, a fifth side panel, and a sixth side panel, wherein the panels are coupled together across a fold line. The first blank includes end flaps extending from the bottom edge of each of the side panels, wherein at least two of the end flaps further include a tab joint extending across a fold line. The method further includes providing a second blank of sheet material having an interior surface and an opposing exterior surface. The second blank having a plurality of side edges equal to a number of side panels of the first blank of sheet material with each side edge having a width substantially equal to a width of the side panels of the first blank. The method further includes forming side walls of the container by folding the first blank along the plurality of fold lines separating the plurality of side panels and coupling the glue panel to the first side panel, coupling each tab joint to an adjacent end flap for forming a foldable connection between adjacent end flaps, and forming a bottom wall of the container by coupling the interior surface of at least two end flaps to the corresponding exterior surface of the second blank.

BRIEF DESCRIPTION OF THE DRAWINGS

Corresponding reference characters indicate corresponding parts throughout the several views of the drawings.

DETAILED DESCRIPTION OF THE INVENTION

A collapsible bulk bin and methods of constructing a collapsible bulk bin are described herein. More specifically, a collapsible bulk bin, including reinforcing straps and a self-erecting solid bottom wall, and methods of constructing the same are described herein. However, it will be apparent to those skilled in the art and guided by the teachings herein provided that the invention is likewise applicable to any storage container including, without limitation, a carton, a tray, a box, or a bin.

In one embodiment, the container is fabricated from a paperboard material. The container, however, may be fabricated using any suitable material, and therefore is not limited to a specific type of material. In alternative embodiments, the container is fabricated using cardboard, corrugated board, plastic and/or any suitable material known to those skilled in the art and guided by the teachings herein provided. The container may have any suitable size, shape, and/or configuration (i.e., number of sides), whether such sizes, shapes, and/or configurations are described and/or illustrated herein. For example, in one embodiment, the container includes a shape that provides functionality, such as a shape that facilitates transporting the container and/or a shape that facilitates stacking and/or arrangement of a plurality of containers.

Figure 1:
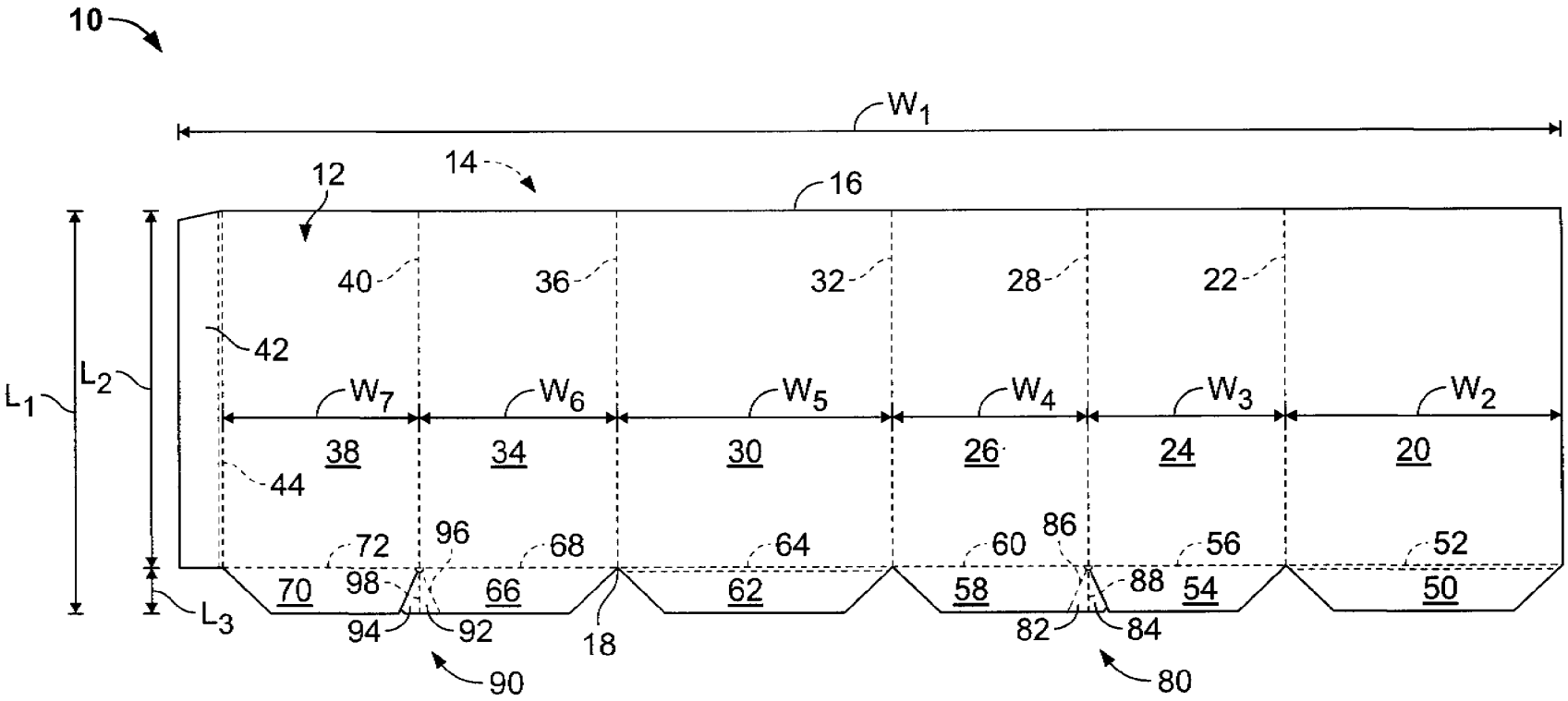
FIG. 1 is a top plan view of a first blank of sheet material for forming a container according to one embodiment of this invention.

Referring now to the drawings, FIG. 1 is a top plan view of a first blank of sheet material 10 for forming a container according to one embodiment of this invention. Specifically, blank 10 is a body blank utilized to form a body of the container. In one embodiment, blank 10 is made of cardboard, corrugated board, plastic, and/or any suitable material. Further, in one embodiment, blank 10 has a width $W_1$ of 149.5 inches and a length $L_1$ of 44 inches. Blank 10 includes an interior surface 12 and an exterior surface 14. Blank 10 also includes a top edge 16 and a bottom edge 18. Blank 10 includes a first side panel 20, coupled across a fold line 22, to a second side panel 24. In one embodiment, first side panel 20 has a width $W_2$ of 29.5 inches and a length $L_2$, and second side panel 24 has a width $W_3$ of 21.5 inches and a length $L_2$. Further, blank 10 includes a third side panel 26, coupled across a fold line 28, to second side panel 24. In one embodiment, third side panel 26 has a width $W_4$ of 21.5 inches and a length $L_2$. Blank 10 also includes a fourth side panel 30, coupled across a fold line 32, to third side panel 26, and a fifth side panel 34, coupled across a fold line 36, to fourth side panel 30. In one embodiment, fourth side panel 30 has a width $W_5$ of 29.5 inches and a length $L_2$, and fifth side panel 34 has a width $W_6$ of 21.5 inches and a length $L_2$. Blank 10 also includes a sixth side panel 38, coupled across a fold line 40, to fifth side panel 34. In one embodiment, sixth side panel 38 has a width $W_7$ of 21.5 inches and a length $L_2$. Sixth side panel 38 includes a glue tab 42 extending across a fold line 44, from an edge opposed to fifth side panel 34. In one embodiment, glue tab 42 has a width $W_8$ of four inches and a length $L_2$, and fold line 44 has a width $W_9$ of one half inch and a length $L_2$.

Blank 10 also includes a plurality of end flaps or major flaps. A first end flap 50 extends from bottom edge 18 of first side panel 20 across a fold line 52. In one embodiment, a portion of first end flap 50 extends a length $L_3$ of five inches from first side panel 20. A second end flap 54 extends from bottom edge 18 of second side panel 24 across a fold line 56. In one embodiment, a portion of second end flap 54 extends length $L_3$ from second side panel 24. A third end flap 58 extends from bottom edge 18 of third side panel 26 across a fold line 60. In one embodiment, a portion of third end flap 58 extends length $L_3$ from third side panel 26. A fourth end flap 62 extends from bottom edge 18 of fourth side panel 30 across a fold line 64. In one embodiment, a portion of fourth end flap 62 extends length $L_3$ from fourth side panel 30. A fifth end flap 66 extends from bottom edge 18 of fifth side panel 34 across a fold line 68. In one embodiment, a portion of fifth end flap 66 extends length $L_3$ from fifth side panel 34. A sixth end flap 70 extends from bottom edge 18 of sixth side panel 38 across a fold line 72. In one embodiment, a portion of sixth end flap 70 extends length $L_3$ from sixth side panel 38.

In alternative embodiments, blank 10 and any portions thereof have any dimensions suitable for forming a bulk bin as described herein.

As shown in FIG. 1, third end flap 58 includes a tab joint or minor flap 80, having a first portion 82 and a second portion 84. First portion 82 is coupled to third end flap 58 across a fold line 86, and second portion 84 is coupled to first portion 82 across a fold line 88. Further, fifth end flap 66 includes a tab joint or minor flap 90 having a first portion 92 and a second portion 94. First portion 92 is coupled to fifth end flap 66 across a fold line 96, and second portion 94 is coupled to first portion 92 across a fold line 98.

Figure 2:
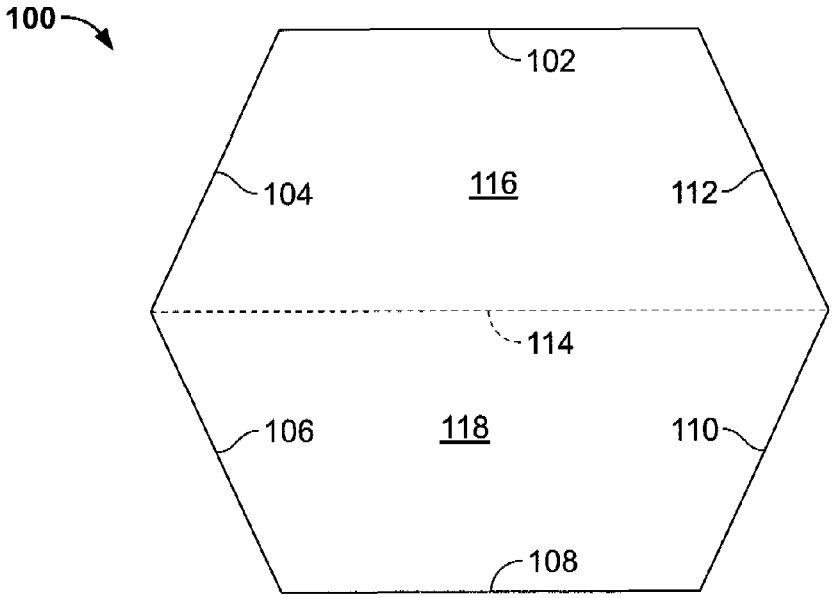
FIG. 2 is a top plan view of a second blank of sheet material for forming a container according to one embodiment of this invention.

FIG. 2 is a top plan view of a second blank of sheet material 100 for forming a container according to one embodiment of this invention. Specifically, blank 100 is a bottom blank utilized to form the container. In one embodiment, blank 100 is a hexagonal shaped blank of sheet material. Blank 100 includes a first edge 102, a second edge 104, a third edge 106, a fourth edge 108, a fifth edge 110, and a sixth edge 112. Blank 100 includes a fold line 114, connecting the junction of second edge 104 and third edge 106 with the junction of fifth edge 110 and sixth edge 112. Fold line 114 separates blank 100 into a first portion 116 and a second portion 118.

Figure 3:
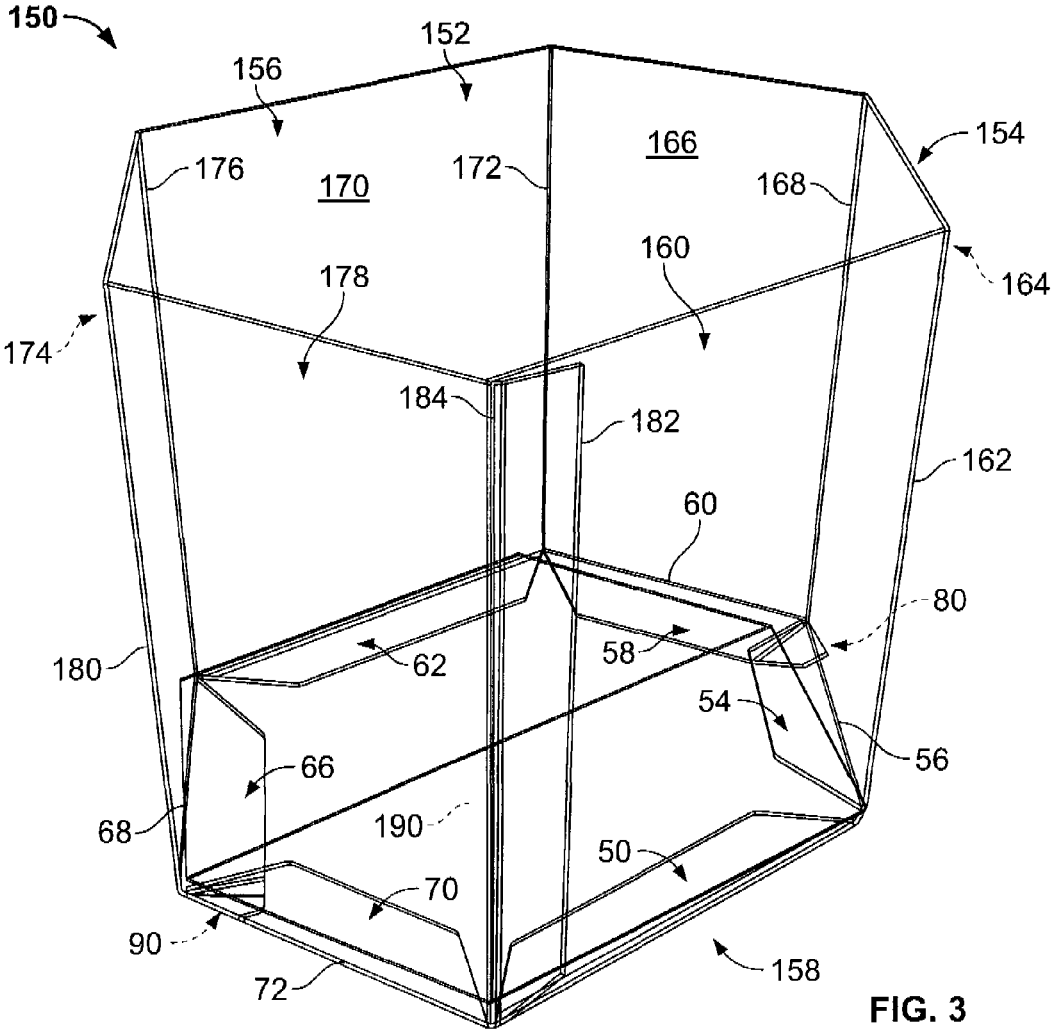
FIG. 3 is a perspective view of the container formed from the first and second blanks as shown in FIGS. 1 and 2.

FIG. 3 is a perspective view of a container 150 formed from first blank 10 of FIG. 1 and second blank 100 of FIG. 2. Container 150 includes an interior 152 and an exterior 154. Container 150 also includes a top opening 156 and a bottom portion 158. Container 150 includes a first side wall 160, coupled across a fold line 162, to a second side wall 164. Container 150 includes a third side wall 166, coupled across a fold line 168, to second side wall 164. Container 150 includes a fourth side panel 170, coupled across a fold line 172, to third side wall 166. Container 150 includes a fifth side wall 174, coupled across a fold line 176, to fourth side wall 170. Container 150 includes a sixth side wall 178, coupled across a fold line 180, to fifth side wall 174. Sixth side wall 178 includes a glue tab 182 extending across a fold line 184, from an edge opposed to fifth side wall 174. Interior 152 of glue tab 182 is coupled to exterior 154 of first side wall 160. In one embodiment, glue tab 182 is adhesively coupled to first side wall 160 using glue. However, any other chemical or mechanical fastener is acceptable for this coupling and any others described below.

Referring further to FIG. 3, blank 100 of FIG. 2 is aligned to form a bottom wall 190. The plurality of end flaps 50, 54, 58, 62, 66, and 70 hold bottom wall 190 within container 150. An interior surface of first bottom flap 50 is coupled to an exterior surface of bottom wall 190. An interior surface of fourth bottom flap 62 is coupled to the exterior surface of bottom wall 190. An interior surface of tab joint 80 is coupled to an exterior surface of second end flap 54 and an interior surface of tab joint 90 is coupled to an exterior surface of sixth end flap 70. The combination of coupling end flaps 50 and 62 to bottom wall 190, and coupling tab joint 80 to end flap 54 and tab joint 90 to end flap 70, holds bottom wall 190 within container 150.

In one embodiment, container 150 may include a liner made of plastic or a similar material for providing a moisture-resistant barrier. Bottom wall 190 is configured to not puncture or cut such liner, which may be placed within container 150. In one embodiment, bottom wall 190 is a solid one-piece construction that has a substantially smooth internal surface. In one embodiment, the internal surface of bottom wall 190 does not include any slits, slots, die-cuts corners, or edges that may pierce or puncture a liner that is positioned within the container.

In one embodiment, bottom wall 190 comprises a single-wall bottom. This design allows a manufacturer to use less material in constructing the bulk container. Because these types of bulk containers are designed to be placed on a pallet for carrying the container, a single-wall construction for bottom wall 190 can be used. In some embodiments, bottom wall 190 is a single-wall bottom and sides 160, 170, 164, 166, 174, and 178 are thicker than bottom wall 190. For example, the sides can be double-wall or triple-wall sides.

Figure 4:
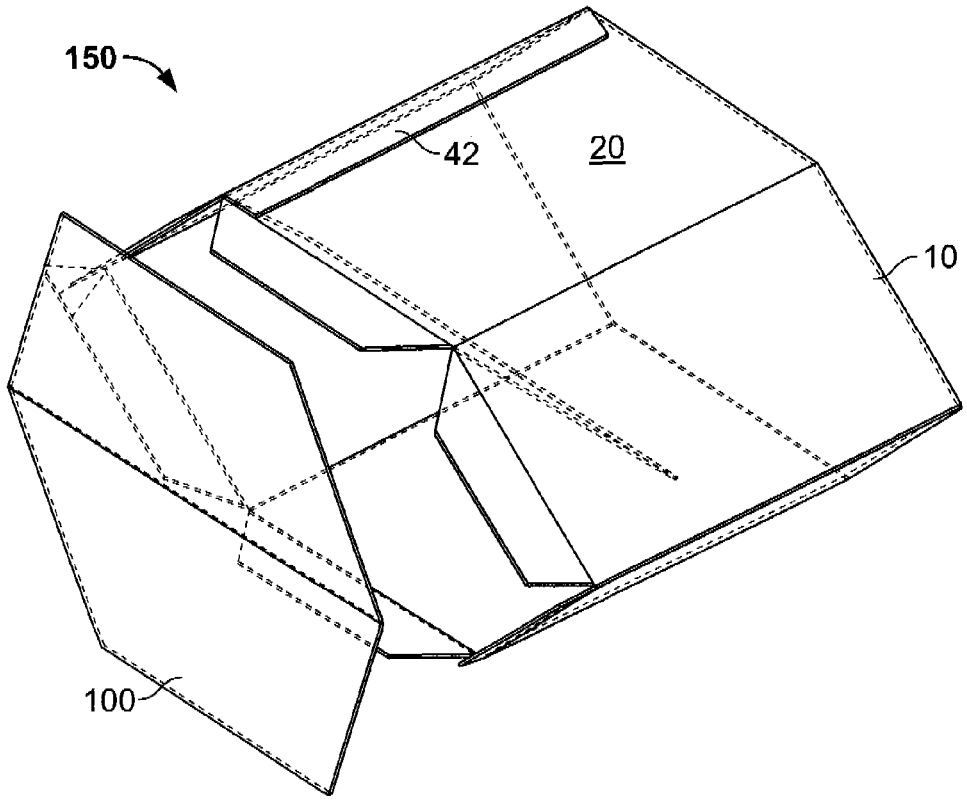
FIG. 4 is a perspective view of the first blank and the second blank in one step of assembly.

FIGS. 4-8 illustrate one exemplary method of assembling container 150. FIG. 4 is a perspective view of first blank 10 and second blank 100 in one step of assembly. Specifically, first blank 10 has been folded such that glue tab 42 is coupled to first side panel 20 to form a hexagonal body, and the hexagonal body is partially erected such that second blank 100 can be inserted therein.

Figure 5:
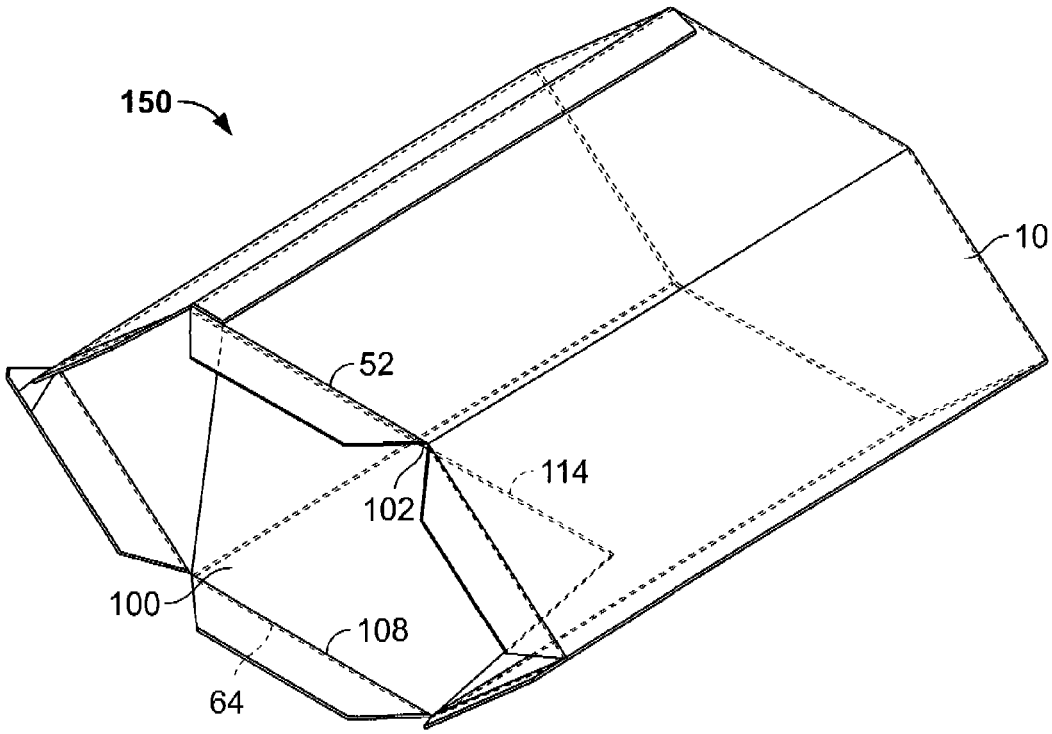
FIG. 5 is a perspective view of the first blank and the second blank in another step of assembly.

FIG. 5 is a perspective view of first blank 10 and second blank 100 in another step of assembly. Second blank 100 is folded substantially ninety degrees along fold line 114 and is inserted into blank 10. Specifically, edge 108 of second blank 100 is aligned with fold line 64 of first blank 10, and edge 102 of second blank 100 is aligned with fold line 52 of first blank 10.

Figure 6:
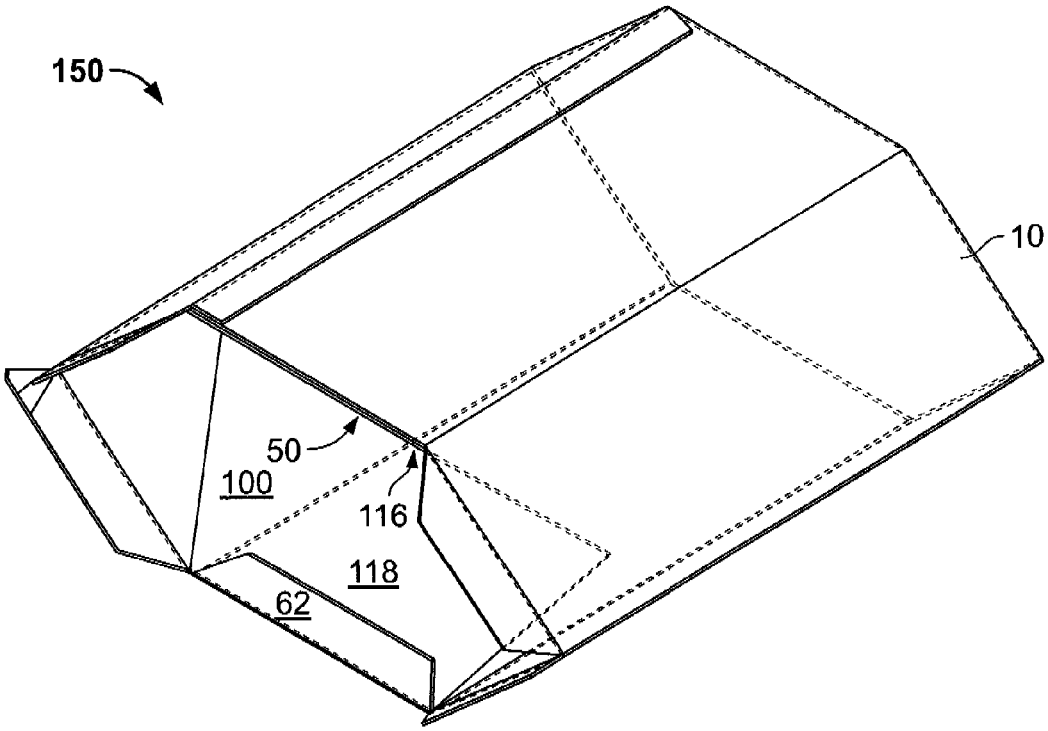
FIG. 6 is a perspective view of the first blank and the second blank in another step of assembly.

FIG. 6 is a perspective view of first blank 10 and second blank 100 in another step of assembly. Major flap 62 of first blank 10 is folded towards and adhered to panel 118 of second blank 100. Further, major flap 50 of first blank 10 is folded towards and adhered to panel 116 of second blank 100.

Figure 7:
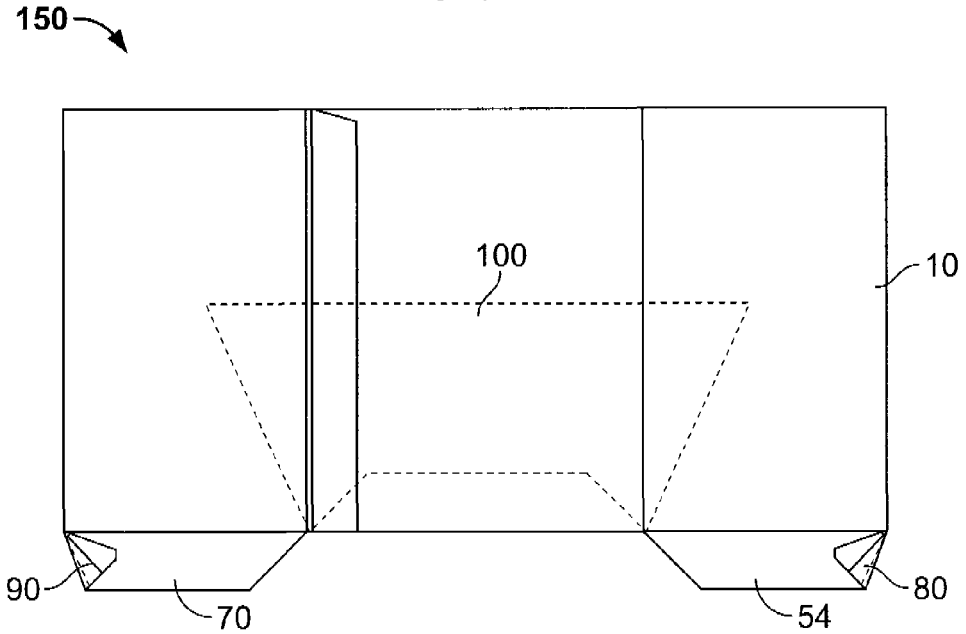
FIG. 7 is a plan view of the first blank and the second blank in another step of assembly.

FIG. 7 is a plan view of first blank 10 and second blank 100 in another step of assembly. First blank 10 is in a collapsed configuration with second blank 100 coupled thereto and positioned therein. Minor flap 90 is folded towards and adhered to major flap 70, and minor flap 80 is folded towards and adhered to major flap 54.

Figure 8:
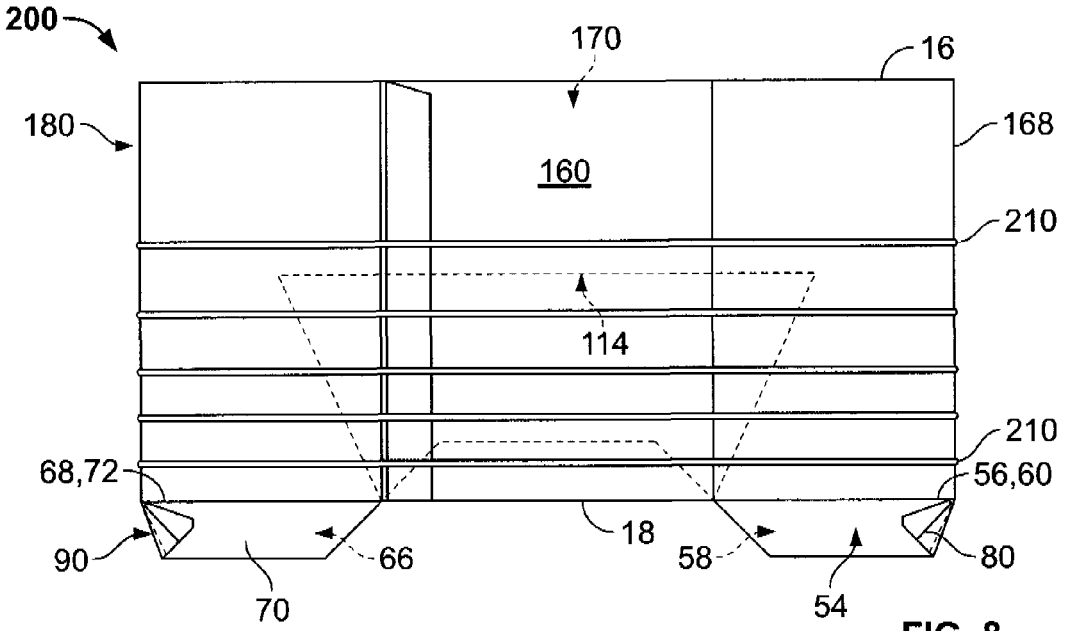
FIG. 8 is a plan view of the container of FIG. 3 in a knocked-down flat configuration and including reinforcing straps.

FIG. 8 is a plan view of an assembled knocked-down flat 200 created from blank 10 (shown in FIG. 1) and blank 100 (shown in FIG. 2) and having a plurality of reinforcing straps 210 wrapped around an exterior surface thereof. Knocked-down flat 200 requires a great deal less space to store, and less space to transport, than fully assembled container 150 (shown in FIG. 3). However, before use, knocked-down flat 200 must be articulated into a usable container. In a first embodiment, to form container 150 from knocked-down flat 200, first side wall 160 is moved out of communication with fourth side wall 170. In one embodiment, top edge 16 of first side wall 160 is pulled away from top edge 16 of fourth side wall 170. In another embodiment, bottom edge 18 of first side wall 160 is pulled away from bottom edge 18 of fourth side wall 170. In yet another embodiment, fold line 168 is pushed toward fold line 180, forcing first side wall 160 apart from fourth side wall 170.

Moving first side wall 160 out of communication with fourth side wall 170 causes blank 100 to rotate about fold line 114, removing first portion 116 (shown in FIG. 2) from communication with second portion 118 (shown in FIG. 2). Moving first side wall 160 out of communication with fourth side wall 170 also removes second end flap 54 from planar communication with third end flap 58. However, tab joint 80 remains coupled to second end flap 54. Second end flap 54 and third end flap 58 rotate about fold lines 56 and 60 respectively, into a substantially perpendicular relationship to side walls 164 and 166 (shown in FIG. 3). When fully articulated, blank 100 is in communication with, and supported by, interior surface 12 (shown in FIG. 1) of end flaps 54 and 58, which are coupled by tab joint 80.

Moving first side wall 160 out of communication with fourth side wall 170 also removes fifth end flap 66 from planar communication with sixth end flap 70. However, tab joint 90 remains coupled to sixth end flap 70. Fifth end flap 66 and sixth end flap 70 rotate about fold lines 68 and 72 respectively, into a substantially perpendicular relationship to side panels 174 and 178 (shown in FIG. 3). When fully articulated, blank 100 is in communication with, and supported by, interior surface 12 (shown in FIG. 1) of end flaps 66 and 70, which are coupled by tab joint 90.

This articulating process can be performed by a single person and without special equipment. By only requiring a single person, employment expenses may be reduced. Also, the time necessary to articulate an assembled container from a knocked-down flat may be reduced, which increases productivity. These benefits are achieved while providing a structurally stable container.

Figure 9:
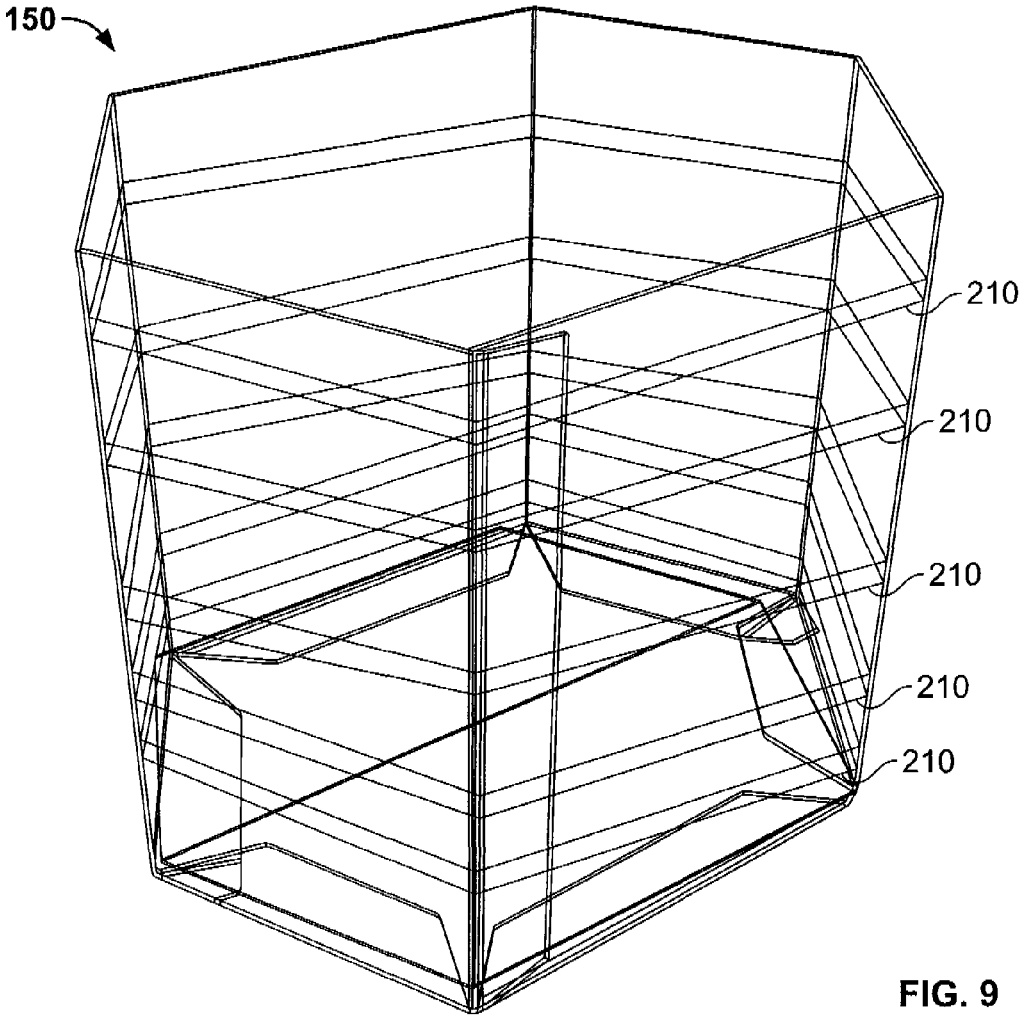
FIG. 9 is a perspective view of the container of FIG. 3, including reinforcing straps.

FIG. 9 is a perspective view of an assembled knocked-down flat 200 created from blank 10 and blank 100 and including reinforcing straps 210. When articulated container 150 is filled with a product to be stored or transported, the product applies pressure to the walls of container 150. One method of reinforcing container 150 to prevent outward bowing of the walls of container 150, is to wrap reinforcing straps 210 around container 150. In one specific example, the straps are made of plastic, but any other material of suitable strength could be utilized.

In one embodiment, the reinforcing straps are flexible plastic straps for providing girth support when the container is in an erected position. The straps are frictionally held in tension around the container vertical side walls. The girth support is provided by the horizontally placed straps at longitudinally spaced locations along the panels. In one embodiment, the straps are polypropylene plastic or of a polyester-type material which are thermally fused or welded together at their ends which secures the straps in sufficient tension outside the container panels for frictionally holding the straps to the container. In one embodiment, the plastic straps include prestretched polypropylene straps, prestretched to provide a low elongation factor and preferably to reduce a typical stretching by approximately fifty percent.

Figure 10:
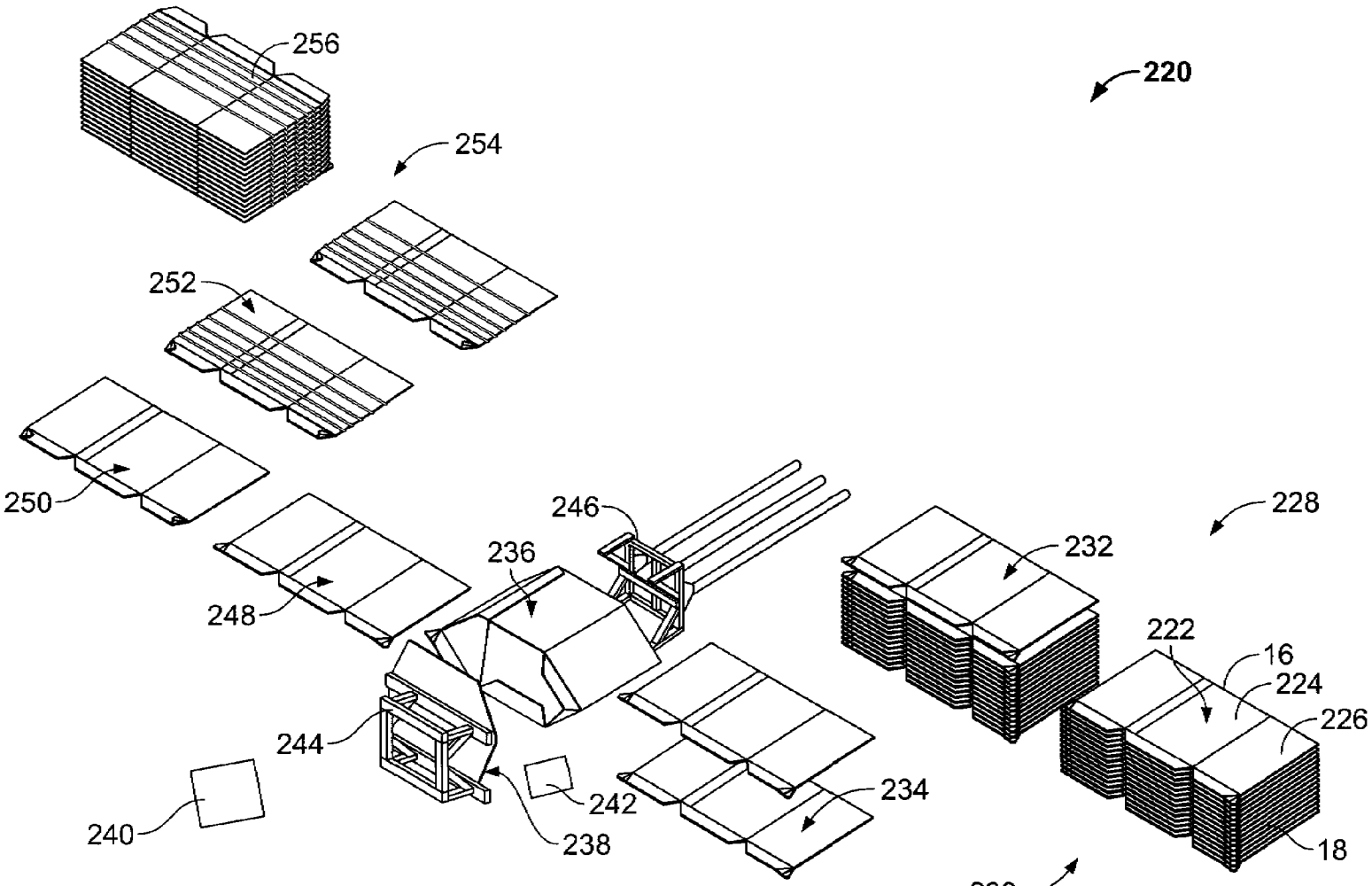
FIG. 10 is a schematic illustration of a mechanism for producing a knocked-down flat, and applying reinforcing straps around the knocked-down flat.

FIG. 10 is a schematic illustration of a second exemplary method of forming knocked-down flat 200, and a mechanism to perform the method. More specifically, FIG. 10 is a schematic illustration of a machine 220 for producing knocked-down flat 200 and applying reinforcing straps 210 around knocked-down flat 200.

Machine 220 includes a bin body pre-stage station 222, for receiving a stack of bin body blanks 224 (i.e., first blank of sheet material 10 of FIG. 1). Stack 224 includes a plurality of individual bin body blanks 226. In one embodiment, stack 224 includes eighty-eight bin body blanks 226. In an alternative embodiment, stack 224 includes any suitable number of blanks that may be formed by machine 220. In operation, an individual body blank 226 is provided to machine 220 for forming knocked-down flat 200. Stack 224 is provided to machine 220 with top edges 16 aligned with a first side 228 of machine 220, and bottom edges 18 aligned with a second side 230 of machine 220.

Machine 220 also includes a transport mechanism to move stack 224 to a bin body feed station 232. In one embodiment, the transport mechanism includes at least one of a powered conveyor, rollers, and any other mechanism suitable for moving stack 224 as described herein. Bin body feed station 232 includes a scissor lift to lift stack 224 towards a vacuum. The vacuum utilizes suction to remove one blank 226 from stack 224. Blank 226 is then moved by the vacuum to a squaring station 234. As each blank 226 is removed from stack 224, the scissor lift lifts the remaining blanks 226 on stack 224, such that the next blank 226 can be removed from stack 224 by the vacuum. The blank 226 that has been moved to squaring station 234 is squared and lowered to a plurality of rollers. The plurality of rollers then move blank 226 into an erecting station 236.

As each blank 226 is placed on squaring station 234 a bottom pad or bottom blank 238 (i.e., second blank of sheet material 100 of FIG. 2) is removed from a bottom pad magazine 240 and prepared for insertion into blank 226. While bottom pad 238 is positioned between bottom pad magazine 240 and erecting station 236, a glue applicator gun 242 applies glue to predetermined locations of bottom pad 238.

At erecting station 236, an erecting device partially erects blank 226 such that bottom pad 238 can be inserted therein. In one embodiment, the erecting device includes a pair of vacuums for suctioning a top portion and a bottom portion of blank 226. Further, bottom pad 238 is folded to a substantially ninety degree angle to provide a female end and a male end. An insertion mechanism 244 located at erecting station 236 is inserted into the female end of folded bottom pad 238, such that insertion mechanism 244 forces the male end of bottom pad 238 toward an opening in the partially erect blank 226. Insertion mechanism 244 continues to insert bottom pad 238 until bottom pad 238 is positioned entirely within blank 226. A first attachment device then folds at least one major flap toward the glued portions of bottom pad 238 and a compression device 246 applies pressure to the portions of bottom pad 238 having glue thereon. As such, the glued portions of bottom pad 238 are forced against blank 226, such that bottom pad 238 is secured to blank 226 to form knocked-down flat 200. In one embodiment, the first attachment device includes a plurality of fingers.

Knocked-down flat 200 is then transported to a collapsing station 248 where knock-down flat 200 is collapsed with bottom pad 238 glued within blank 226. A plurality of rollers then transport knocked down flat 200 to a tab joint or minor flap sealing station 250. Glue is applied to tab joints 80 and 90 and a second attachment device folds tab joints 80 and 90 such that they are sealed against second end flap 54 and sixth end flap 70, respectively. In one embodiment, the second attachment device includes a plurality of fingers. Knocked-down flat 200 is then transferred to a strapping station 252 where a plurality of straps are simultaneously applied around knocked-down flat 200. Knocked-down flat 200 is then placed on a unitizing station 254 to be stacked with other knocked-down flats 200. Knocked-down flats 200 are positioned on unitizing station 254 in an alternating configuration. Specifically, a first flat 200 is positioned such that top edge 16 is aligned with first side 228 of machine 200. A second flat 200 is then positioned on top of the first flat with bottom edge 18 aligned with first side 228 of machine 200. By alternating flats 200, the weight of flats 200 is distributed to facilitate forming a level stack 256.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

The above-described apparatus and methods facilitate providing a bulk bin assembly capable of being erected and collapsed by a single person. Further, the above-described apparatus and methods provide a bulk bin assembly that is reinforced to facilitate providing strength against a weight of materials placed therein.

Although the apparatus and methods described herein are described in the context of a reinforced bulk bin assembly and method for making the same, it is understood that the apparatus and methods are not limited to reinforced bulk bin assemblies. Likewise, the reinforced bulk bin assembly components illustrated are not limited to the specific embodiments described herein, but rather, components of the reinforced bulk bin assembly can be utilized independently and separately from other components described herein.

While the invention has been described in terms of various specific embodiments, those skilled in the art will recognize that the invention can be practiced with modification within the spirit and scope of the claims.

What is claimed is:

1. A container configured to be selectively moved between a substantially flat position and a deployed position, the container comprising:

a plurality of side walls formed from a first blank of sheet material, wherein the first blank comprises a first side panel coupled across a side fold line to a second side panel, a third side panel coupled across a side fold line to the second side panel, a fourth side panel coupled across a side fold line to the third side panel, a fifth side panel coupled across a side fold line to the fourth side panel, and a sixth side panel coupled across a side fold line to the fifth side panel, the sixth side panel having a glue tab extending from an edge opposed to the fifth side panel, wherein the first blank further comprises end flaps extending from a bottom edge of each of the side panels, at least two of the end flaps each include a minor flap at least partially defined by a cut line;

at least two tab joints, each tab joint comprises one of the at least two minor flaps coupled across a joint fold line to a respective adjacent end flap and adhered to the respective adjacent end flap in an at least partially overlapping manner; and a bottom wall formed from a second blank of sheet material, the second blank coupled to a first end flap and an opposing fourth end flap of the first blank such that the second blank is (i) configured to fold along a bottom fold line into a position between the plurality of side walls when the container is in the substantially flat position, and (ii) in communication with a second end flap, a third end flap, a fifth end flap, and a sixth end flap of the first blank when the container is in the deployed position.

2. The container according to claim 1, wherein the second blank comprises a first panel coupled to a second panel across the bottom fold line, the first panel and the second panel are disposed in a face-to-face relationship when the container is in the substantially flat position.

3. The container according to claim 1, wherein the third end flap includes a first of the at least two minor flaps, and the fifth end flap includes a second of the at least two minor flaps, the first of the at least two minor flaps is folded and coupled to the second end flap to form a first of the at least two tab joints, and the second of the at least two minor flaps is folded and coupled to the sixth end flap to form a second of the at least two tab joints.

4. The container according to claim 1, wherein the end flaps are configured to support the second blank for forming the bottom wall of the container.

5. The container according to claim 1, wherein the respective cut lines defining each of the minor flaps extend obliquely with respect to the bottom edges of the side panels.

6. The container according to claim 1, wherein the first blank and the second blank are fabricated from at least one of paper, paperboard, and corrugated paperboard.

7. The container according to claim 1, further comprising a plurality of continuous straps positioned around an exterior surface of the first blank, wherein each strap is positioned in a predetermined location between a top edge and a bottom edge of the first blank.

8. The container according to claim 1, wherein the container further comprises a liner placed within the container, and wherein the second blank is a solid one-piece construction having a substantially smooth interior surface.

9. The container according to claim 8 wherein the second blank does not include slits, slots, or die-cut corners capable of puncturing the liner.

10. A container configured to be selectively moved between a substantially flat position and a deployed position, the container comprising:

a plurality of side walls formed from a first blank of sheet material, the side walls having a top edge and a bottom edge;

a plurality of end flaps, each end flap emanating from the bottom edge of a respective one of the side walls, at least two of the end flaps include a respective minor flap at least partially defined by a cut line;

at least two tab joints, each tab joint comprises one of the at least two minor flaps coupled across a joint fold line to a respective adjacent one of the end flaps and adhered to the respective adjacent end flap in an at least partially overlapping manner; and a bottom wall formed from a second blank of sheet material, the second blank coupled to a first end flap and an opposing fourth end flap of the plurality of end flaps such that the second blank is (i) configured to fold along a bottom fold line into a position between the plurality of side walls when the container is in the substantially flat position, and (ii) at least partially supported by a second end flap, a third end flap, a fifth end flap, and a sixth end flap of the plurality of end flaps when the container is in the deployed position.

11. The container according to claim 10, wherein the second blank comprises a first panel coupled to a second panel across the bottom fold line, the first panel and the second panel are disposed in a face-to-face relationship when the container is in the substantially flat position.

12. The container according to claim 10, wherein the respective cut lines defining each of the minor flaps extend obliquely with respect to the bottom edges of the side walls.

13. The container according to claim 10, further comprising a plurality of continuous straps positioned around an exterior surface of the first blank, wherein each strap is positioned in a predetermined location between the top and bottom edges of the side walls when the container is in the deployed position and in the substantially flat position.

14. A method for constructing a container, the method comprising:

folding a plurality of side panels of a first blank along a plurality of side fold lines, wherein the first blank includes a first side panel coupled across a first of the side fold lines to a second side panel, a third side panel coupled across a second of the side fold lines to the second side panel, a fourth side panel coupled across a third of the side fold lines to the third side panel, a fifth side panel coupled across a fourth of the side fold lines to the fourth side panel, and a sixth side panel coupled across a fifth of the side fold lines to the fifth side panel, the sixth side panel having a glue panel extending from an edge opposed to the fifth side panel, wherein the first blank further includes end flaps extending from a bottom edge of each of the side panels, at least two of the end flaps each include a minor flap at least partially defined by a cut line;

coupling the glue panel to the first side panel to form a plurality of side walls of the container;

folding and coupling each minor flap across a joint fold line to a respective adjacent one of the end flaps to form at least two foldable tab joints; and coupling each of a first end flap and an opposing fourth end flap of the first blank to a second blank, wherein the container is movable to a deployed position by positioning the second blank in communication with a second end flap, a third end flap, a fifth end flap, and a sixth end flap of the first blank to form a bottom wall of the container, and wherein the container is foldable to a substantially flat position such that the second blank folds along a bottom fold line into a position between the plurality of side walls.

15. The method according to claim 14, wherein providing a second blank further comprises providing a second blank having a bottom fold line extending across the second blank to define a first panel and a second panel, such that when the container is in the substantially flat position the second blank is folded along the bottom fold line positioning the first panel and second panel in a face to face relationship.

16. The method according to claim 14, wherein the third end flap includes a first of the at least two minor flaps, and the fifth end flap includes a second of the at least two minor flaps, and wherein coupling each minor flap across the joint fold line further comprises:

folding and coupling the first of the at least two minor flaps to the second end flap to form a first of the at least two foldable tab joints; and folding and coupling the second of the at least two minor flaps to the sixth end flap to form a second of the at least two tab joints.

17. The method according to claim 14, wherein the respective cut lines defining each of the minor flaps extend obliquely with respect to the bottom edges of the side panels.

18. The method according to claim 14, further comprising positioning at least one continuous strap around an exterior surface of the first blank.

19. The method according to claim 14, further comprising positioning a plurality of continuous straps around an exterior surface of the first blank, wherein each strap is positioned in a predetermined location between a top edge and the bottom edge of the first blank.

20. The method according to claim 14, further comprising wrapping a plurality of continuous straps around an exterior surface of the first blank at substantially the same time when the container is in the substantially flat position.

* * * * *